US005191220A

United States Patent [19]

Innes

[11] Patent Number: 5,191,220

[45] Date of Patent: Mar. 2, 1993

[54] FLAME MONITORING APPARATUS AND METHOD HAVING A SECOND SIGNAL PROCESSING MEANS FOR DETECTING A FREQUENCY HIGHER IN RANGE THAN THE PREVIOUSLY DETECTED FREQUENCIES

[75] Inventor: David C. K. G. Innes, Shepperton, England

[73] Assignee: Hamworthy Combustion Equipment Limited, Maidstone, England

[21] Appl. No.: 751,180

[22] Filed: Aug. 28, 1991

[30] Foreign Application Priority Data

Sep. 6, 1990 [GB] United Kingdom ..... 9019457

[51] Int. Cl.[5] ..... G01J 31/14

[52] U.S. Cl. ..... 250/554; 340/578

[58] Field of Search ..... 250/554, 214 AG, 528; 340/578

[56] References Cited

U.S. PATENT DOCUMENTS 3,936,648 2/1976 Cormault et al. ..... 250/554
4,039,844 8/1977 MacDonald ..... 250/554
5,077,550 12/1991 Cormier ..... 250/554

FOREIGN PATENT DOCUMENTS

209102A1 1/1987 European Pat. Off. .
1960218 6/1971 Fed. Rep. of Germany .
2132342A 7/1984 United Kingdom .

OTHER PUBLICATIONS

Willson, P. M., et al., "Pulverised Fuel Flame Monitoring in Utility Boilers", Measurement & Control, Mar. 1985, vol. 18, pp. 66–72.

*Primary Examiner*—David C. Nelms
*Assistant Examiner*—T. Davenport
*Attorney, Agent, or Firm*—Dennis T. Griggs

[57] ABSTRACT

The presence of a burner flame, in a multiple burner installation, is monitored by sensing a signal indicative of the spectrum of the fluctuating component in the radiation of the flame over a range of frequencies. In the lower frequency range a measure is obtained of the difference of signal strength at two predetermined frequency levels. The signal strength is also measured at a higher frequency. At the higher frequency there is a significant difference in signal intensity between the flame-on and flame-off conditions, while the change of signal strength between the spectra of flame-on and flame-off conditions in the lower frequency range is sensitive to frequency. By processing the two measures together they can augment each other and produce an enhanced change of signal between flame-on and flame-off conditions, making detection easier.

7 Claims, 2 Drawing Sheets

FLAME MONITORING APPARATUS AND METHOD HAVING A SECOND SIGNAL PROCESSING MEANS FOR DETECTING A FREQUENCY HIGHER IN RANGE THAN THE PREVIOUSLY DETECTED FREQUENCIES

BACKGROUND OF THE INVENTION

This invention relates to an apparatus and method for monitoring the presence of a flame.

It is known to use a monitor with radiation sensing means for the remote detection of a flame. The direct illumination from the flame, characterised by its flickering nature, is distinguished from the sensed radiation by filtering out of the signal any steady-state background illumination.

Further precautions may be needed where there may be multiple sources of fluctuating radiation, such as exist in multi-burner equipment, to ensure that the radiation from another source does not influence the reading for the flame being monitored. In industrial boiler installations, for example, there may be a bank of closely spaced burners each of which have to be monitored individually. The space available may then be so limited that it is not possible to site each radiation detector where its line of sight will impinge on the combustion zone of only a single burner. Typically, the detector may be located to one side of the burner with its optical axis inclined towards the burner axis so as to enter the flame at a point along its length nearer the burner outlet than the tip of the flame. If the flame should be extinguished, the combustion zone of another flame could become visible along the line of sight. This problem is further complicated by the fact that the loss of a flame from one burner may allow the flames of adjacent burners to spread towards the space previously occupied by the extinguished flame.

A solution to this problem is offered by an apparatus known from GB 1396384 in which there are two radiation sensors directed onto the flame from one side of the burner, as already mentioned, but aligned on axes that intersect near their point of entry into the flame. Signal processing means for the output signals from the sensor devices filter out any non-identical components from the two signals to give the processed signal that, in principle, is dependent on the fluctuating radiation from the zone of intersection of the two detector axes.

Such an apparatus, while it offers an effective solution for the problem, is inherently both expensive and space-consuming because it requires the two radiation sensors and the joint processing of their outputs. It is an object of the present invention to provide a more cost-effective approach.

SUMMARY OF THE INVENTION

According to one aspect of the present invention, there is provided flame monitoring apparatus comprising means for sensing radiation from the flame and for producing a detection signal related to the sensed fluctuating radiation over a range of frequencies, means for producing a measure of the detection signal strength at least at two different frequencies in said range and for providing an output depending upon the relative strengths of said signals in order to indicate the presence of the flame.

According to another aspect of the invention, there is provided a method of monitoring a flame by sensing the fluctuating illumination from that flame and deriving signals of the radiation strength at least at two different frequencies of fluctuation, and employing said derived signals to produce an output signal dependent upon the relative strengths of said signals, to indicate the presence of the flame.

The invention is based upon the observation that the frequency characteristic of a flame varies over its extent. For an obliquely aligned flame monitor in a multi-burner set-up, the line of sight from the intended zone of the flame to be monitored will extend to some other zone of a neighboring flame that might be sensed if the intended flame is extinguished. The frequency spectrum of a signal from the monitor will thus differ, in dependence upon which flame is being sensed.

A typical frequency spectrum for the flame being monitored from the illumination towards the base of the flame will show a progressive reduction in the signal intensity with increase of frequency, this being more marked in the lower frequency range. Although there may not be much difference in the magnitudes of the signals sensed at these lower frequencies from one flame or the other, a clearer difference emerges between the two flames by providing a measure of the change of amplitude between two frequencies in the lower frequency range. In this way it is possible, therefore, to discriminate between burner-on and burner-off conditions.

In a preferred form of the invention, a third measurement of the radiation is made at a higher frequency. In conventional detection techniques it is a higher frequency component that provides the measurement signal because, by choosing an appropriate region of the flame for monitoring, the higher frequency component will have a greater magnitude when the flame is on. In known apparatus, however, the change of signal level this represents can only be used reliably if there is a high degree of discrimination in the signal processing means, which carries its own disadvantages. By comparing both the relative intensity changes in the lower frequency range, where the difference in intensity level at any particular frequency in the two conditions may be relatively small, and the different levels of high frequency signal in the burner-on and burner-off conditions, it becomes much easier to distinguish reliably the loss of an individual burner flame.

For example, from a sensed fluctuating signal, the processing may produce an output signal related to the ratio of the high-frequency component to the difference between the two lower-frequency components of the sensed signal, although other processing algorithms are possible. By suitable choice of frequencies in particular cases, at least one of the two components of the lower-frequency difference signal may show a significant change of magnitude between burner-on and burner-off conditions; it would then be possible to perform a similar processing in which that one of the two components forming the frequency difference signal takes the place of the higher frequency component in the algorithm.

As another example, it may be preferred in some cases to produce a ratio signal rather than a difference signal from the two lower frequency components and form a ratio of this with the high-frequency component.

BRIEF DESCRIPTION OF THE DRAWINGS

The invention will be described in more detail by way of example with reference to the accompanying schematic drawings wherein.

DESCRIPTION OF THE PREFERRED EMBODIMENTS

Figure 1:
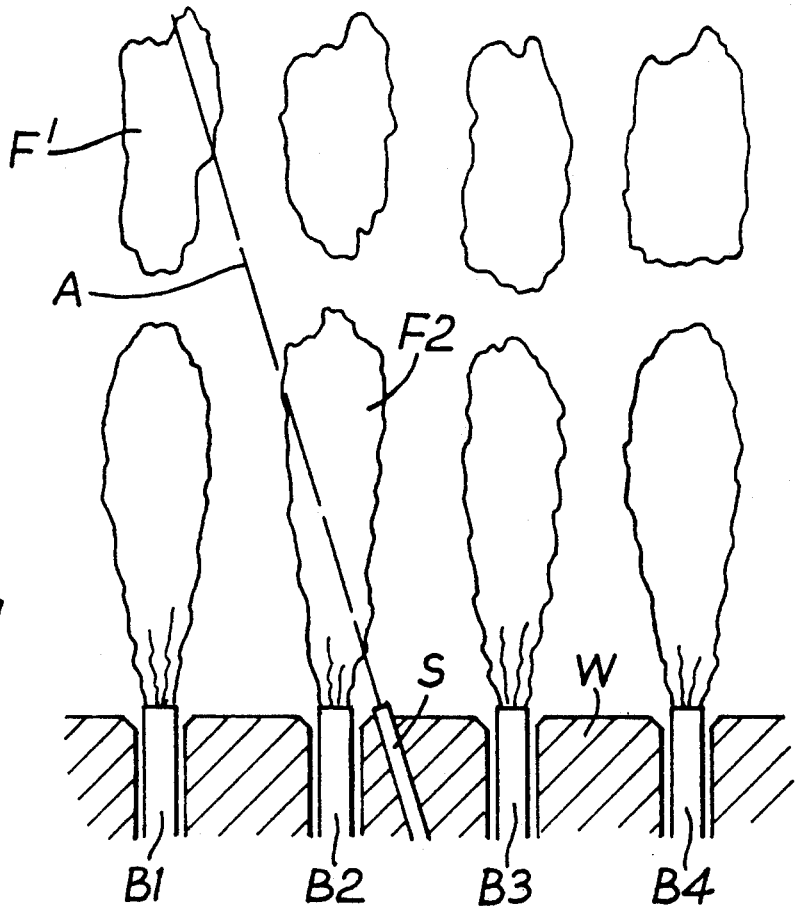
FIG. 1 illustrates in plan a multiple burner arrangement with the sighting head of a flame monitor in place for one of the burners.

FIG. 1 is a horizontal section of a burner wall W in a boiler, showing a row of burners B1,B2 . . . at the level of the section plane. The sighting head S of a flame monitoring device is illustrated only schematically because such equipment is well known, for example as supplied by Peabody Holmes Ltd of Maidstone, England. In such devices a sighting head is mounted obliquely in the wall so that its optical axis A impinges on the flame F2 of the burner B2 being monitored, about one third of the length of the flame from the burner.

FIG. 1 also shows, as an example that the axis A may meet a more distant zone of a flame F' from one of a further row of burners at a lower level, although the presence of the flame intended to be monitored will normally mask this other flame from the sensor.

Figure 2:
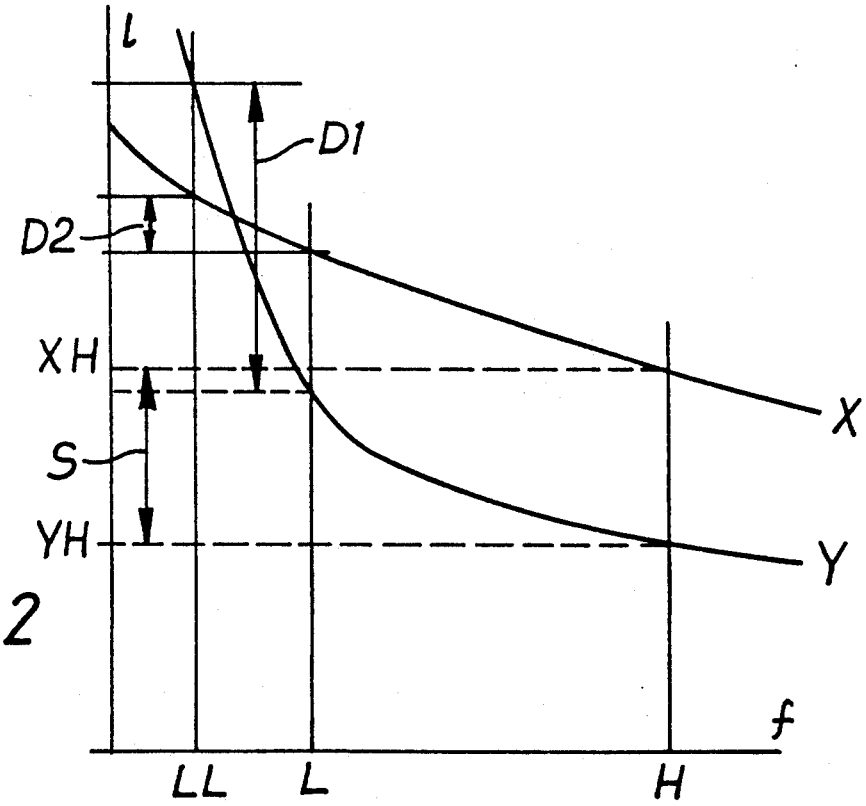
FIG. 2 is a graph showing typical frequency spectra that might reach the sighting head in FIG. 1, and FIGS. 3 and 4 illustrate alternative means of processing the sensed signals in accordance with the invention.

The sighting head S comprises a transducer which senses a chosen optical spectrum (the spectrum range depending in known manner on the fuel being burnt) as a corresponding electrical signal. As already explained, the radiation from the flame F contains a flickering or fluctuating component and the sighting head is arranged not to respond to any steady-state illumination. With the burner lit, therefore, a spectrum X is sensed which is shown in FIG. 2 as a plot of fluctuating signal level (L) against frequency (F). If the burner B2 is unlit, the sighting head still receives a fluctuating signal (spectrum Y) from the remaining burners, but as FIG. 2 illustrates, this is considerably weaker in the higher frequency range, such as at the frequency H. In known flame detectors, the fluctuating signal from the sighting head will be processed so as to detect the change of signal level (S) between XH and YH.

The higher frequency band is a clear choice for measurement of the signal since it can be seen from FIG. 2 that there is highest signal ratio between the burner on and off conditions. FIG. 2 also shows that the two spectra sensed have significantly dissimilar profiles. In particular, in the low frequency range their rates of change of signal strength with frequency are very different. As a result although the difference in magnitude between the signals at any particular frequency in this range may be small, over a low frequency band such as L to LL the change between the differences (D1 and D2) of the signal strengths at the frequency values L and LL or the ratios of the strengths at those values will have very different magnitudes.

By combining appropriately these changes at the higher and lower frequency regions of the spectrum, it is possible to enhance very considerably the sensed difference between the burner on and burner off conditions. For example, the difference between the signal strengths at the two lower frequencies L and LL is much greater when the burner is off. This difference value may be subtracted from the absolute signal value at the higher frequency H, and since a larger difference value is subtracted from a higher frequency signal that is already smaller when the burner is off, there is substantially improved discrimination between the on and off conditions.

Figure 3:
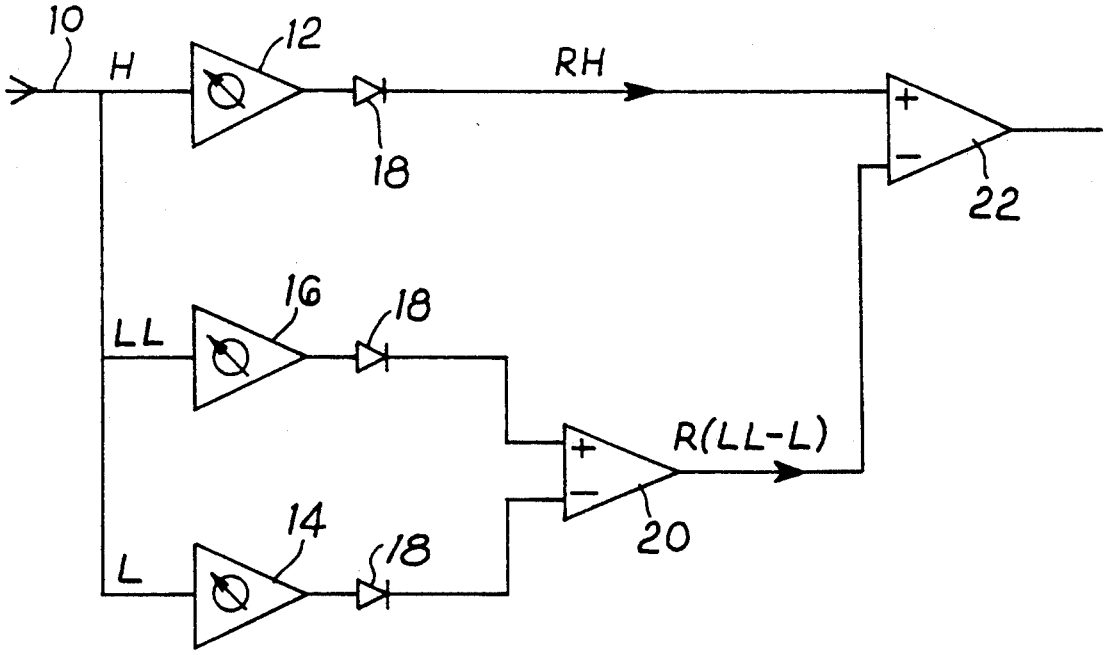

This process-is operated by the apparatus in FIG. 3. The signal from the sighting head is input through terminal 10 to three variable gain amplifiers 12,14,16 in parallel having rectifier diodes 18 at their outputs. The amplifiers 12,14,16 have, respectively, high frequency, low frequency and very low frequency pass bands (H,L,LL). In fact, it may not be necessary for all the amplifiers to have specific top pass cut-off frequencies because of the fall-off of signal strength with frequency. The outputs from the amplifiers L and LL go to a differential amplifier 20 to produce a signal proportional to D1 or D2 which is arranged not to go negative, as it is subtracted from the high frequency signal in a further differential amplifier 22. The change of high frequency signal, proportional to the input strength drop S, which appears upon loss of the flame is thus augmented by the change of the lower frequency difference signal from D2 to D1 to give a greater resultant change in the output from the amplifier 22.

As a numerical example, in adverse conditions, ie. when the sighting head receives a considerable amount of fluctuating illumination from other sources, the ratio between the burner-on and burner-off states of the detected signal at the higher frequency H may conceivably fall to 5:3. But at the lower frequencies L and LL, the signal differences in the two states might be 1 and 2 respectively. By subtraction, therefore, the ratio is changed from 5:3 to 4:1, which clearly provides a much greater discrimination between the two states. The two low frequencies are chosen in this case to be relatively close together in order to ensure that the signal strengths at those values will tend to fluctuate together. As a result there is a substantially steady difference signal, so that its influence on the high frequency value will be stable.

Figure 4:
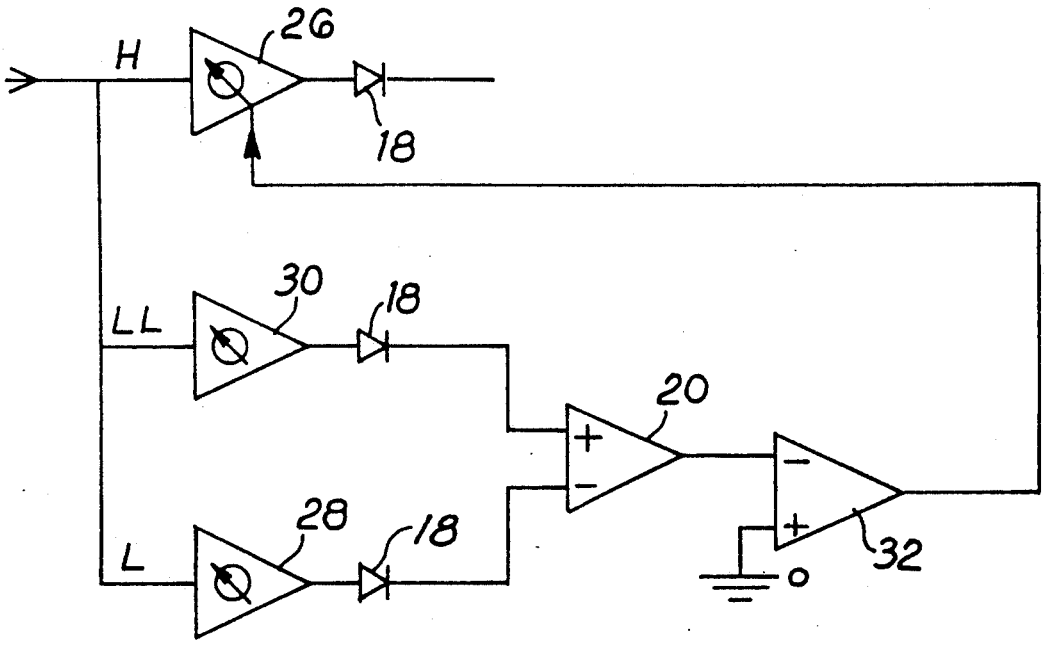

In FIG. 4 there are transconductance amplifiers 26,28,30 operating on similar frequency bands to the three amplifiers of FIG. 3, and the amplifiers 28,30 similarly feed the differential amplifier 20. The difference signal is inverted in a further differential amplifier 32 and the inverted output provides a gain control signal for the higher frequency amplifier 26. The gain in that amplifier is therefore reduced when it is operating on the weaker higher frequency signal. In an analogous way it is possible to process the two lower frequency signals to produce an output that is a ratio of their strengths.

As in the previous example, the change in the difference of the lower frequency signals augments the change of high frequency signal between the burner-on and burner-off conditions. In the case of FIG. 4, with the numerical input values given above as an example for the FIG. 3 circuit, the change in the gain ratio between burner-on and burner off conditions would be 1:0.5. The ratio between the high frequency signals of 5:3 is thereby modified to 5:1.5

It is to be understood that the frequency values chosen for the pass bands will depend upon the particular installation and more particularly upon the type of fuel being used. It is, however, very simple to establish empirically from the spectra the frequency values that will determine the optimum values.

I claim:

1. Flame monitoring apparatus comprising, in combination:

means for sensing radiation from a flame to be monitored and for producing a detection signal related to the sensed fluctuations of said radiation over a range of frequencies;

first signal processing means for producing a measure of the detection signal strength at least at two different frequencies in said range;

means for providing an output signal depending upon the relative strength of said detection signal at said two frequencies;

second signal processing means for producing a further measure of the detection signal strength at a higher frequency than said two frequencies; and, means interacting an output signal from said higher frequency measure with said output signal derived from the relative signal strength at said two lower frequencies for providing a resultant output signal exhibiting a change of relative signal strength between flame-on and flame-off conditions in order to indicate the presence of the flame being monitored.

2. Apparatus according to claim 1 comprising means for generating a resultant output signal proportional to a ratio value of the signal strength of said higher frequency output to the output signal derived from the detection signal strengths at said two different frequencies.

3. Apparatus according to claim 1 comprising means for generating a resultant output signal proportional to a difference value between the signal strength of said higher frequency output and the output signal derived from the detection signal strengths at said two different frequencies.

4. Combustion apparatus having a plurality of burners and radiation detection means directed obliquely to at least one of the burners for sensing a flame from said one burner and for producing a detection signal related to the sensed fluctuations of said radiation over a range of frequencies, including means for producing a measure of the detection signal strength at least at two different frequencies in said range;

means for providing an output signal depending upon the relative strengths of said detection signal at said two frequencies in order to indicate the presence of the flame;

second signal processing means for producing a further measure of the detection signal strength at a higher frequency than said two frequencies; and, means interacting an output signal from said higher frequency measure with said output signal derived from the relative signal strength at said two lower frequencies for providing a resultant output signal exhibiting a change of relative signal strength between flame-on and flame-off conditions in order to indicate the presence of the flame being monitored.

5. A method of monitoring a burner flame comprising the steps of:

sensing fluctuating illumination from said flame;

deriving a signal of the radiation strength of the fluctuating illumination at two different frequencies;

employing said derived signals to produce an output signal dependent upon the relative strength of said signals;

deriving a further said signal of radiation strength of the fluctuating illumination at a higher frequency than said two frequencies; and, processing said signal of the higher frequency strength with said signals of said two frequencies to produce a resultant output signal exhibiting a change of relative signal strength between flame-on and flame-off conditions, thereby to indicate the presence of the flame being monitored.

6. A method according to claim 5 wherein the resultant output signal is produced from the ratio of the signal strength of said higher frequency output to the output signal derived from the detection signal strengths at said two different frequencies.

7. A method according to claim 5 wherein the resultant output signal is produced in proportion to a difference value between the signal strength of said higher frequency output and the output signal derived from the detection signal strengths at said two different frequencies.

* * * * *